US007740369B2

(12) United States Patent
Gabriel et al.

(10) Patent No.: US 7,740,369 B2
(45) **Date of Patent: *Jun. 22, 2010**

(54) HANDHELD POWER TOOL, IN PARTICULAR A POWER DRILL OR SCREWDRIVER

(75) Inventors: Thomas Gabriel, Kirchheim-Jesingen (DE); Markus Leupert, Murrhardt (DE)

(73) Assignee: Robert Bosch GmbH, Stuttgart (DE)

( * ) Notice: Subject to any disclaimer, the term of this patent is extended or adjusted under 35 U.S.C. 154(b) by 8 days.

This patent is subject to a terminal disclaimer.

(21) Appl. No.: 12/108,226

(22) Filed: Apr. 23, 2008

(65) Prior Publication Data

US 2008/0266841 A1 Oct. 30, 2008

(30) Foreign Application Priority Data

Apr. 25, 2007 (DE) ..... 10 2007 019 436

(51) Int. Cl.
*B25B 23/18* (2006.01)

(52) U.S. Cl. ..... 362/119; 362/220; 362/276

(58) Field of Classification Search ..... 362/119, 362/120, 276; 173/46
See application file for complete search history.

(56) References Cited

U.S. PATENT DOCUMENTS

| | | | | |
|---|---|---|---|---|
| 3,141,171 | A * | 7/1964 | Doyle et al. | 227/2 |
| 5,557,990 | A | 9/1996 | Shin | |
| 6,318,874 | B1 * | 11/2001 | Matsunaga | 362/119 |
| 6,527,404 | B2 * | 3/2003 | Wang | 362/119 |
| 7,498,526 | B2 * | 3/2009 | Lohr et al. | 200/5 A |
| 2002/0048166 | A1 * | 4/2002 | Matsunaga | 362/119 |
| 2007/0256914 | A1 | 11/2007 | Lohr et al. | |

FOREIGN PATENT DOCUMENTS

| | | |
|---|---|---|
| DE | 10 2004 051 913 | 2/2006 |

* cited by examiner

*Primary Examiner*—Thomas M Sember
(74) *Attorney, Agent, or Firm*—Michael J. Striker

(57) ABSTRACT

A handheld power tool has a tool holder, which is received displaceably in a housing and is drivable via a drive unit that can be switched on and off upon an axial adjusting motion of the tool holder. A lighting unit on the handheld power tool can be switched on and/or off via the adjusting motion of the tool holder.

10 Claims, 4 Drawing Sheets

HANDHELD POWER TOOL, IN PARTICULAR A POWER DRILL OR SCREWDRIVER

CROSS-REFERENCE TO A RELATED APPLICATION

The invention described and claimed hereinbelow is also described in German Patent Application DE 102007019436.8 filed on Apr. 25, 2007. This German Patent Application, subject matter of which is incorporated herein by reference, provides the basis for a claim of priority of invention under 35 U.S.C. 119(a)-(d).

BACKGROUND OF THE INVENTION

The invention relates to a handheld power tool, in particular to a power drill or power screwdriver, such as a battery-operated screwdriver.

In U.S. Pat. No. 5,557,990, a battery-operated screwdriver is described, which includes a tool holder, received displaceably in a housing, for receiving a tool; the tool holder is driven by an electric drive motor. The battery-operated screwdriver is provided with a push-start mechanism, which enables automatic starting of the drive motor as soon as the tool in the tool holder is placed with pressure on the screw to be screwed in or unscrewed and the tool holder has been displaced axially backward some distance into the housing, whereupon a switching mechanism is actuated that switches on the electric motor. A radially projecting actuating element is axially displaced by the tool holder and pressed against a microswitch by way of which the electric motor is to be switched on and off; with the aid of a spring element, the tool holder is displaced backward to its original position as soon as the screwdriver is moved away from the screw. The actuating element, which is acted upon by the tool holder and switches the microswitch on and off, is located in the housing of the power tool on the axial face end of the tool holder and is pressed by the spring element against the face end of the tool holder.

Furthermore, from German Patent Disclosure DE 10 2004 051 913 A1, a battery-operated screwdriver is known, whose tool holder is located axially fixedly in the housing and is driven by the rotor shaft of an electric drive motor. On the housing of the battery-operated screwdriver, there is a switch key for switching the drive motor on and off; the switch key can assume various switching positions, in which different current circuits of different current consumers are switched on and off. Via one of these current circuits, workplace lighting can be activated; depending on the position of the switch key, the workplace lighting can be activated either by itself or jointly with the motor rotation.

SUMMARY OF THE INVENTION

Based on this prior art, the object of the invention is to keep the current consumption arising from the lighting means of a handheld power tool low.

In keeping with these objects and with others which will become apparent hereinafter, one feature of the present invention resides, briefly stated, in a handheld power tool, comprising a housing; a tool holder which is received displaceably in said housing; a drive unit which drives said tool holder and which is switchable on and off upon an axial adjusting motion of said tool holder; and at least one lighting means switchable on and off by a displacement motion of said tool holder.

Another feature of the present invention resides, briefly stated, in a handheld power tool, which further comprises a rotation-direction setting switch via which said lighting means is switchable on and/or off, said rotation-direction setting switch being configured so that a direction of rotation of said tool holder is settable by said rotation-direction setting switch.

The handheld power tool of the invention has a tool holder, received displaceably in a housing, and this tool holder can be driven by a drive unit which can be switched on and off upon an axial adjusting motion of the tool holder. This so-called push-start mechanism makes it possible to switch the drive unit of the handheld power tool automatically on and off as soon as a sufficiently great pressure is exerted on the tool holder in the axial direction, and particularly when the tool bit received in the tool holder is placed on a screw or the like. If the pressure is withdrawn, then the tool holder can resume its axial outset position, whereupon the drive unit is shut off automatically.

According to the invention, it is provided that a lighting means on the handheld power tool can be switched on and/or off via the adjusting motion of the tool holder. The adjusting motion of the tool holder is thus utilized not only for switching the drive unit on and off but for switching the lighting means as well. Thus there is a functional coupling, at least in the switching-on motion, between the actuation of the drive unit and the actuation of the lighting means. Advantageously, the adjusting motion of the tool holder is also used to shut off the drive unit for shutting off the lighting means; optionally, alternative shutoff mechanisms for shutting off the lighting means can also be considered, such as a shutoff via a time switch after a preset period of time following the shutoff of the drive unit has elapsed.

Switching the lighting unit on and off is advantageously done via a microswitch, which is switched on and off by an actuating element that is axially solidly connected to the tool holder and thus executes the same axial adjusting motion as the tool holder. The microswitch preferably has the task primarily of switching the drive unit on and off but is also used for switching the lighting means. In this way, a separate microswitch associated with the lighting means can be dispensed with.

In a further version according to the invention, the lighting means can be switched on and/or off via a rotation-direction setting switch, by way of which the counterclockwise or clockwise rotation of the tool holder is set. The actuation of the rotation-direction setting switch is used in particular to switch on the lighting means, but optionally, switching off the lighting means can also be done by way of the actuation of the rotation-direction setting switch. It is furthermore possible for the lighting means to be switched off with the aid of a time switch after a preset period of time after the termination of the work operation has elapsed.

Optionally, the lighting means is switched on and/or off with the aid of the on/off switch of the drive unit; fundamentally, switching on and/or switching off via a separate switch can also be considered, and in that version, the work field can be lighted even before the screwdriver is placed on the screw, thus minimizing the risk that it will slip off the screw.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
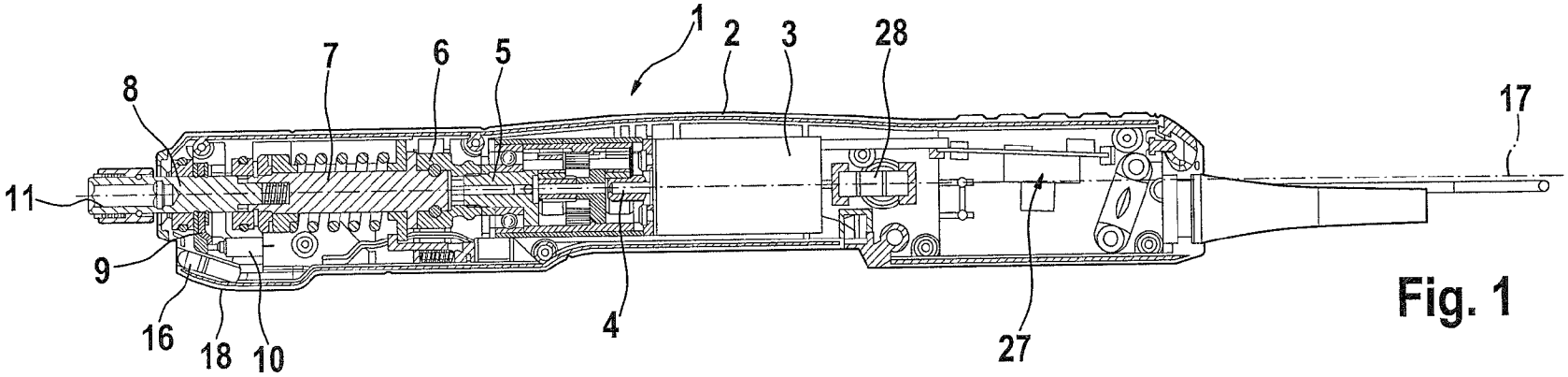
FIG. 1 is a section through a handheld power tool, embodied as an in-line screwdriver that has a power cord and that is equipped with a push-start mechanism.

In the drawings, identical components are identified by the same reference numerals.

Figure 4:
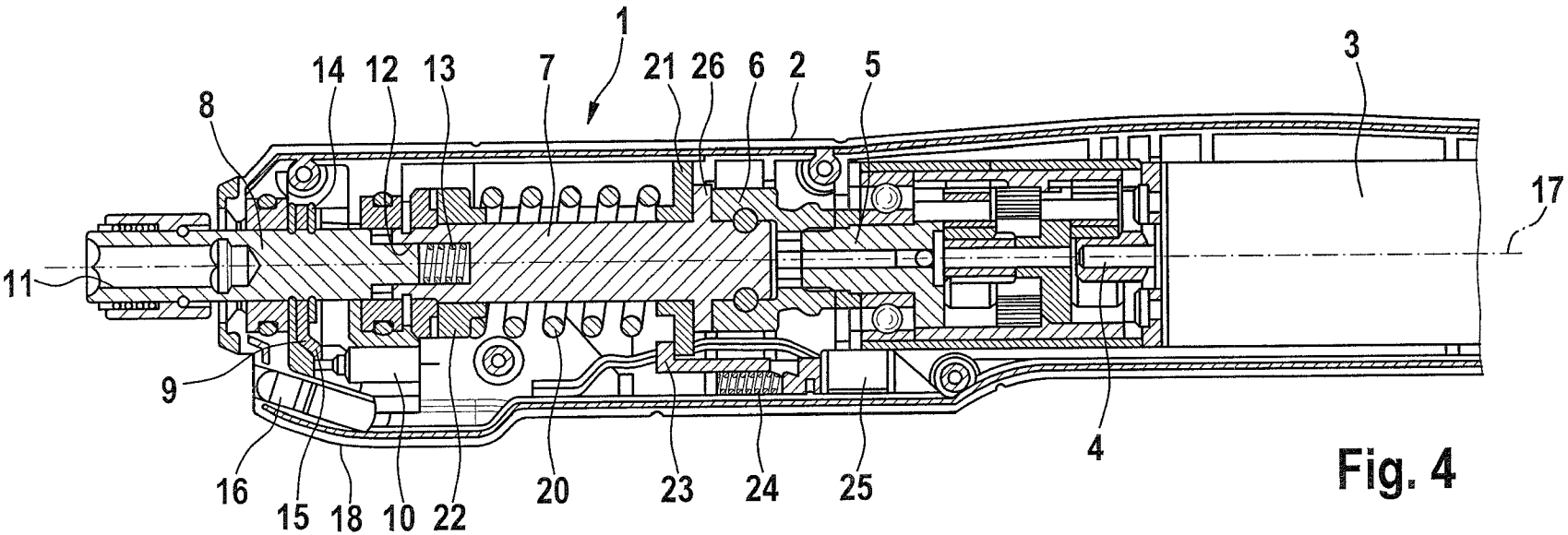
FIG. 4 shows a sectional view, corresponding to FIG. 1, of the handheld power tool, but in an enlarged view of the front part, in which the tool holder with the push-start mechanism is received.

As FIG. 1 and the enlarged view in FIG. 4 show, the screwdriver 1 has a housing 2, in which an electric drive motor 3 is received. The rotor shaft 4 of the electric drive motor 3 acts as the drive shaft, which via a planet carrier 5 is connected by the gear to a coupling member 6 in a manner fixed against relative rotation; for transmitting a preset maximum torque, the coupling member 6 is seated on a driven shaft 7. The driven shaft 7 is connected in a manner fixed against relative rotation to a tool holder 8 for receiving a tool, in particular a screwdriver or screwdriver bit, and the tool holder 8, for receiving the tool, has a face-end recess 11 in a portion located outside the housing 2.

The tool holder 8 is retained axially displaceably relative to the driven shaft 7 but is joined positively to the driven shaft in the rotary direction, so that the rotary motion of the driven shaft 7 is also transmitted to the tool holder 8. A recess 12 (FIG. 4) is made in the face end of the driven shaft 7, and a spring element 13 embodied as a compression spring is inserted into this recess. The spring element 13 is acted upon by a peg of tapered cross section of the tool holder 8 that protrudes into the recess 12. As long as no forces are acting on the tip, which receives the tool, of the tool holder 8, the tool holder 8 is maximally forced out of the housing 2 of the battery-operated screwdriver 1 in the axial direction because of the spring force of the spring element 13.

Because of the axial displaceability of the tool holder 8, the tool holder can be shifted axially inward counter to the force of the spring element 13, as soon as the tool, received in the recess 11 in the tool holder 8, is pressed against a screw or the like. The actuating element 9, located solidly on the jacket face of the tool holder 8, thereupon comes into contact with the microswitch 10 and puts it in the ON state, whereupon the microswitch 10, which is connected to the electronics of the drive motor 3, switches this motor on. The actuating element 9 comprises an actuation ring 14, which surrounds the jacket face of the tool holder 8 and is expediently axially retained by two securing rings, and an actuation tab 15, which is embodied in one piece with the actuation ring 14 and is embodied as a radially projecting portion that extends in the direction of the microswitch 10 and is embodied for actuating the microswitch 10.

As soon as the tool received in the tool holder 8 is force-free, the tool holder 8, under the influence of the spring element 13, is axially displaced back into its outset position, in which the tool holder protrudes maximally far out of the housing 1. The actuating element 9 thereupon becomes disengaged from the microswitch 10, so that the microswitch 10 is converted from the ON to the OFF state, and the electric drive motor 3 is switched off.

The actuating element 9 is solidly connected in the axial direction to the tool holder 8, but the actuating element 9 does not execute the rotary motion of the tool holder 8; instead, it is solidly connected in the rotary direction to the housing 2 of the screwdriver 1.

In the lower, front part of the housing 2, there is a lighting means 16, embodied in particular as a light-emitting diode (LED), which illuminates the work field of the handheld power tool. For that purpose, the lighting means 16 is located at an oblique angle to the longitudinal axis 17 of the handheld power tool, in such a way that the free face end of the tool holder 8 and the areas in front of the face end are all illuminated. The lighting means 16 is received in a bulging portion 18 of the housing 2.

The lighting means 16 is switched on and off via the axial displacement motion of the tool holder 8. This is done in particular in such a way that the switching state of the lighting means 16 is controlled via the microswitch 10, which thus has the task not only of switching the electric drive motor 3 on and off but also of switching the lighting means 16 on and off. Switching the lighting means 16 on and off is thus done in the same way as the switching on and off of the electric drive motor. Optionally, however, only switching on is done via the microswitch and hence via the electronics 27 of the drive motor, while switching off is conversely done in a timed manner via the electronics.

Figure 2:
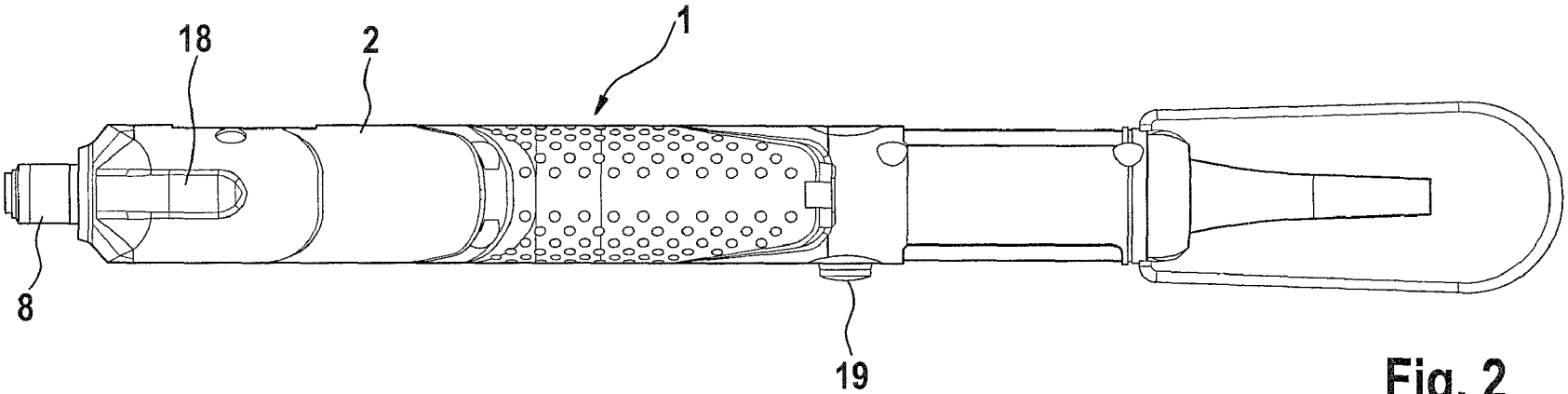
FIG. 2 shows the handheld power tool in a view from below.
Figure 3:
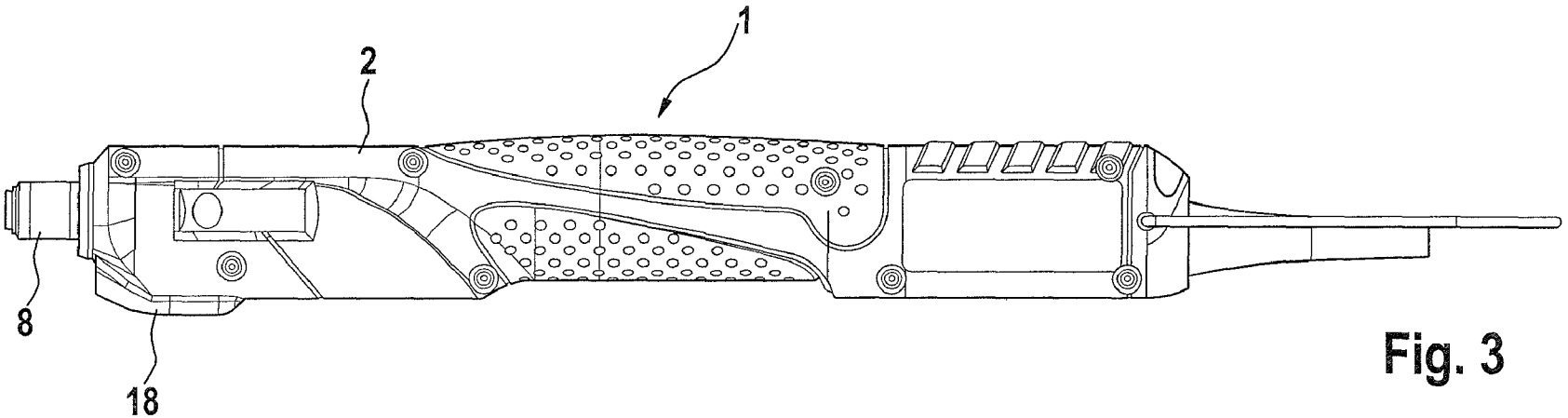
FIG. 3 shows the handheld power tool in a side view.

Switching the lighting means 16 on and optionally also off can also be done via a rotation-direction setting switch 19 (FIG. 2), by way of which the direction of rotation of the tool holder 8 can be fixed or reversed. In the exemplary embodiment, the rotation-direction setting switch 19 is located in the lateral area of the housing and is embodied as a spring-loaded push button, which presses on a further microswitch 28 which is located inside the screwdriver. The shutoff of the lighting means is typically done in timed fashion via the electronics 27 of the drive motor.

Figure 5:
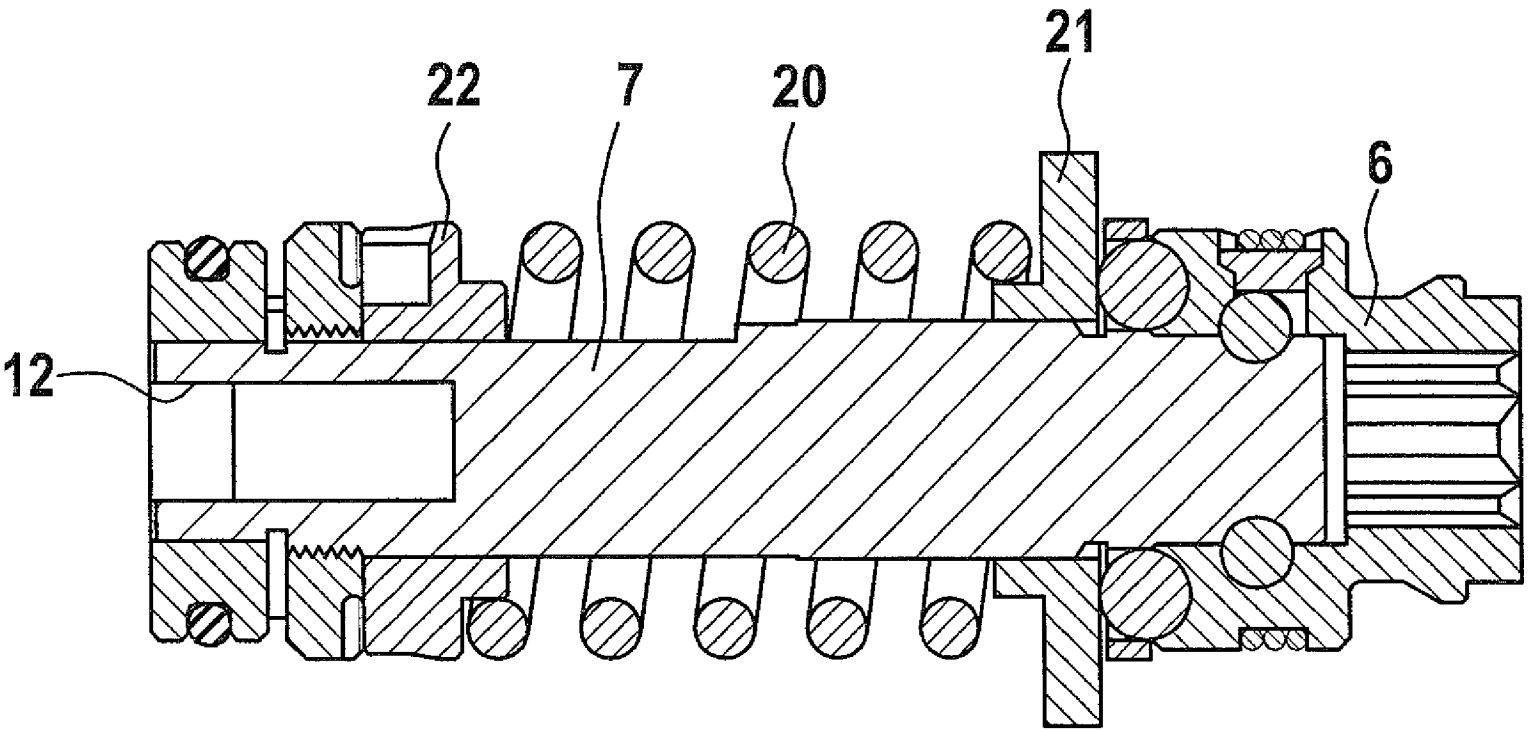
FIG. 5 is an individual sectional view showing the driven shaft of the handheld power tool, the shaft being connected on one end to a coupling member and on the other end having a recess for a spring element that acts upon the face end of the tool holder.

As further shown in FIGS. 4 and 5, the shutoff of the electric drive motor can also be done via a torque shutoff device. The torque shutoff device includes a switching element 23, which is subjected to force by a compression spring 24 and is kept by the compression spring in contact with a shutoff microswitch 25; in the contact position of the switching element 23, the shutoff microswitch 25 is on. The switching element 23 is retained axially adjustably in the housing 2 and can be put into the out-of-contact position with the shutoff microswitch 25 by a bearing disk 21, which is seated on the jacket face of the driven shaft 7 and is located axially displaceably on the driven shaft.

The bearing disk 21 is located on the side of the driven shaft facing toward the coupling member 6 and defines one end of a compression spring 20 that is embodied as a spiral spring and that on the other end is fixed on the driven shaft 7 by a second bearing disk 22. The bearing disk 21 moves axially away from the coupling member 6 as soon as the tightening torque of the tool holder 8, or of the tool received in it, matches the torque of the coupling member 6. In this axial motion—to the left in terms of FIGS. 4 and 5—the switching element 23 is displaced out of the contact position with the shutoff microswitch 25 into the out-of-contact position, counter to the force of the compression spring 24, whereupon the shutoff microswitch 25, via the electronics, shuts off the electric drive motor 3. As already noted, the shutoff may, however, also be done in timed fashion via the electronics 27.

As soon as the bearing disk 21, by the force of the compression spring 20, is displaced back into its outset position, in which the bearing disk 21 rests axially on an annular shoulder 26 of the driven shaft 7, the switching element 23 also, by the force of the compression spring 24, again moves toward the shutoff microswitch 25, whereupon this shutoff microswitch is displaced into the ON position that switches the electric drive motor on.

Advantageously, the lighting means 16 is shut off automatically, as soon as the shutoff microswitch 25 switches the electric drive motor 3 off.

It may also be practical for the lighting means 16 not to be switched off until a preset length of time has elapsed, via a time switch after the completion of the work step or in other words after the shutoff of the electric drive motor. In that case, the shutoff of the lighting means 16 occurs only with a time lag after the shutoff of the electric drive motor.

It will be understood that each of the elements described above, or two or more together, may also find a useful application in other types of constructions differing from the type described above.

While the invention has been illustrated and described as embodied in a handheld power tool, in particular a power drill or screwdriver, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A handheld power tool, comprising:

a housing;

a tool holder which is received displaceably in said housing;

a drive unit which drives said tool holder and which is switchable on and off upon an axial adjusting motion of said tool holder; and at least one lighting means switchable on and off by said axial adjusting displacement motion of said tool holder, wherein said lighting means is configured so as to illuminate a work field of the handheld power tool.

2. A handheld power tool as defined in claim 1; and further comprising a microswitch wherein said microswitch is configured to switch said drive unit on and off and is actuatable by the axial adjusting motion of said tool holder, said microswitch being configured so that it is simultaneously switches said lighting means on and off.

3. A handheld power tool as defined in claim 2; and further comprising an actuating element, wherein said actuating element is configured to switch said microswitch and is connected axially solidly to said tool holder.

4. A handheld power tool as defined in claim 1; and further comprising a rotation-direction setting switch via which said lighting means is switchable on and/or off, said rotation-direction setting switch being configured so that a direction of rotation of said tool holder is settable by said rotation-direction setting switch.

5. A handheld power tool as defined in claim 1, wherein said lighting means is configured as a light-emitting diode.

6. A handheld power tool as defined in claim 1; and further comprising a time switch which is configured to shutoff said lighting means after a termination of a work operation.

7. A handheld power tool as defined in claim 1, wherein said drive unit has an on/off switch configured for switching on and/or off said lighting means.

8. A handheld power tool as defined in claim 1, wherein said drive unit is configured as an electric drive unit.

9. A handheld power tool as defined in claim 1, wherein the handheld power tool is a handheld power tool selected from the group consisting of a power drill and a power screwdriver.

10. A handheld power tool as defined in claim 9, wherein the power screwdriver is configured as a battery-operated screwdriver.

* * * * *